US005359849A

United States Patent [19]

Auffret et al.

[11] Patent Number: 5,359,849

[45] Date of Patent: Nov. 1, 1994

[54] AFTERBURNER ASSEMBLY FOR A GAS TURBINE ENGINE

[75] Inventors: Didier L. C. Auffret, Combs la Ville; Gérard C. L. Berger, Quincy s/Senart; Eric Conete, Le Mee s/Seine; Frédéric Delage, Paris; Gérard E. A. Jourdain, Saintry sur Seine; Christophe J. F. Thorel, Paris, all of France

[73] Assignee: Societe National D'Etude et de Construction de Moteurs D'Aviation, Paris Cedex, France

[21] Appl. No.: 162,883

[22] Filed: Dec. 8, 1993

[30] Foreign Application Priority Data

Dec. 16, 1992 [FR] France ..... 9215119

[51] Int. Cl.[5] ..... F02K 3/10

[52] U.S. Cl. ..... 60/261; 60/749; 60/753

[58] Field of Search ..... 60/261, 740, 749, 753

[56] References Cited

U.S. PATENT DOCUMENTS

| | | | |
|---|---|---|---|
| 3,269,116 | 8/1966 | Frasca et al. | 60/749 |
| 3,485,945 | 12/1969 | Riecke . | |
| 4,626,461 | 12/1986 | Prewo et al. | 428/113 |
| 4,671,997 | 6/1987 | Galasso et al. | 428/408 |
| 4,716,640 | 1/1988 | Jourdain et al. . | |
| 4,962,070 | 10/1990 | Sullivan | 501/95 |
| 5,001,898 | 3/1991 | Holladay | 60/261 |
| 5,132,256 | 7/1992 | Beall et al. | 501/95 |

FOREIGN PATENT DOCUMENTS 2024403 1/1980 United Kingdom .

*Primary Examiner*—Richard A. Bertsch
*Assistant Examiner*—William Wicker
*Attorney, Agent, or Firm*—Bacon & Thomas

[57] ABSTRACT

An afterburner assembly is disclosed in which the flameholder ring is formed by plurality of flameholder ring segments, each segment being integrally formed with a generally radially extending arm. The flameholder ring segments extend beyond each opposite sides of the arm. The arm and flameholder ring segments are attached to the casing of the afterburner by a support element which is pivotally attached to the arm and fixedly attached to the afterburner casing. The distal end of the arm slidably contacts the casing defining the opposite side of the afterburner duct to enable the arm to slide relative to the casing to allow for differential thermal expansion of the respective elements. When each of the arm/flameholder ring segments are attached to the afterburner casing, the flameholder ring segments form a generally annular flameholder ring. The ring has a generally "U"-shaped cross-sectional configuration with the legs of the "U"-shape extending generally parallel to a central axis and opening in a downstream direction according to the gas flow flowing through the afterburner duct.

36 Claims, 3 Drawing Sheets

AFTERBURNER ASSEMBLY FOR A GAS TURBINE ENGINE

BACKGROUND Of THE INVENTION.

The present invention relates to an afterburner assembly for a gas turbine engine, such as an aircraft turbojet, wherein the afterburner flameholders exhibit a simplified construction.

Afterburners for turbojet engines are well-known in the art and typically comprise one or more annular flameholder rings supported within the afterburner duct. It is also known to make the flameholder rings from composite materials. However, the prior art devices have been affixed to the casings defining the afterburner duct by separate, generally radially extending arms which renders the designs comparatively heavy and bulky. Furthermore, the bulky structure introduces disturbances and pressure drops within the gases flowing through the afterburner thereby reducing the overall efficiency of the gas turbine engine.

SUMMARY OF THE INVENTION

An afterburner assembly is disclosed in which the flameholder ring is formed by plurality of flameholder ring segments, each segment being integrally formed with a generally radially extending arm. The flameholder ring segments extend beyond each opposite sides of the arm. The arm and flameholder ring segments are attached to the casing of the afterburner by a support element which is pivotally attached to the arm and fixedly attached to the afterburner casing. The distal end of the arm slidably contacts the casing defining the opposite side of the afterburner duct to enable the arm to slide relative to the casing to allow for differential thermal expansion of the respective elements.

When each of the arm/flameholder ring segments are attached to the afterburner casing, the flameholder ring segments form a generally annular flameholder ring. The ring has a generally "U"-shaped cross-sectional configuration with the legs of the "U"-shape extending generally parallel to a central axis and opening in a downstream direction according to the gas flow flowing through the afterburner duct.

The arm/flameholder ring segment is formed as an integral unit from composite material. The support member may also be formed of a composite material, either the same composite material as the arm/-flameholder ring segment, or a different composite material, or may be formed of other materials, such as metal.

The composite material comprises a fiber preform clad by a matrix, wherein the preform maybe either silicon carbide fibers or carbon fibers and wherein the matrix is either silicon carbide or carbon carbide.

The primary advantage of the instant afterburner assembly over the known afterburner assemblies is its simplicity of manufacture and assembly, its low weight and low bulk coupled with high thermal resistance due to the fabrication from a suitable composite material.

DETAILED DESCRIPTION OF THE PREFERRED EMBODIMENT

Figure 1:
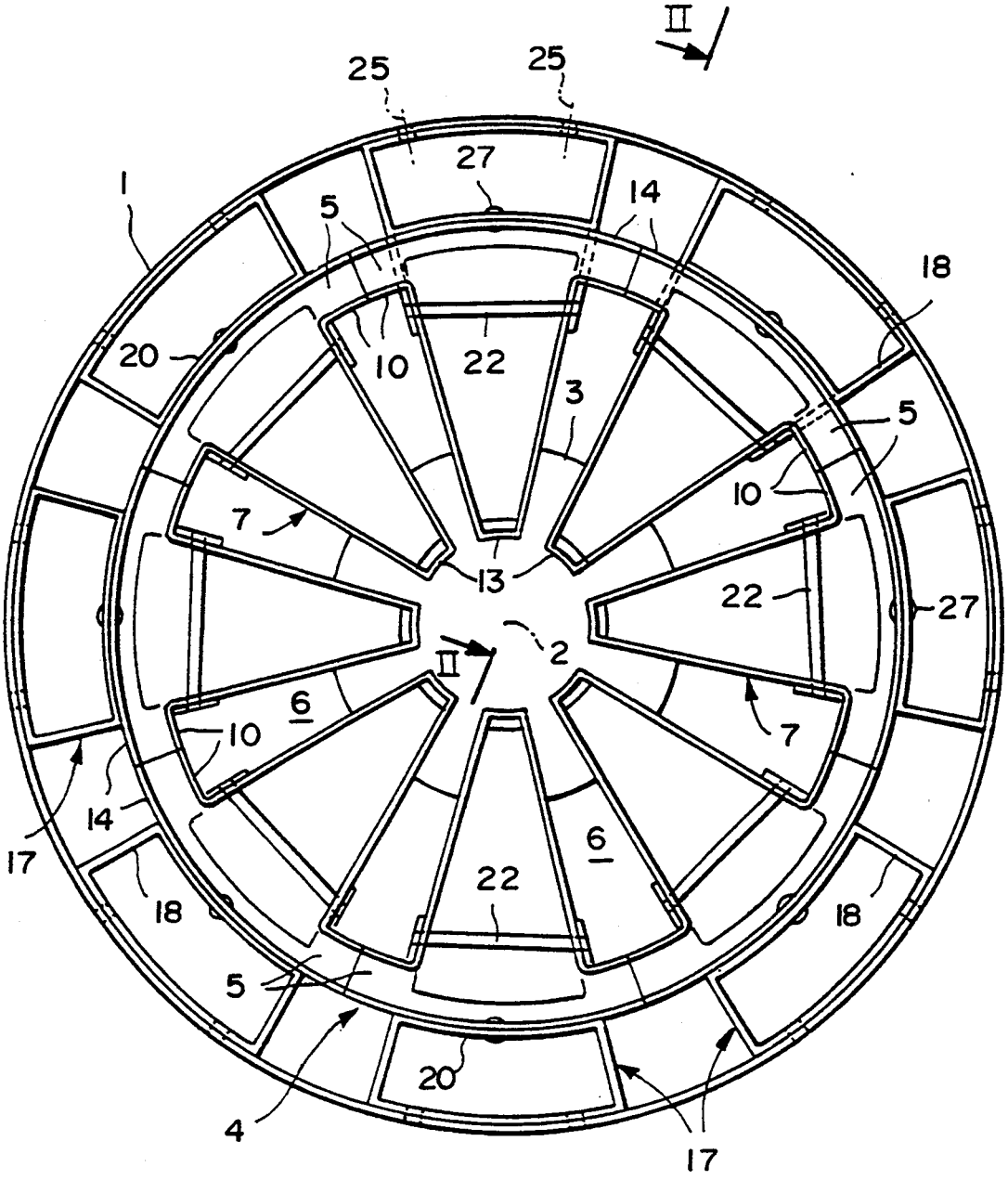
FIG. 1 comprises a rear view of the afterburner assembly according to the present invention.
Figure 2:
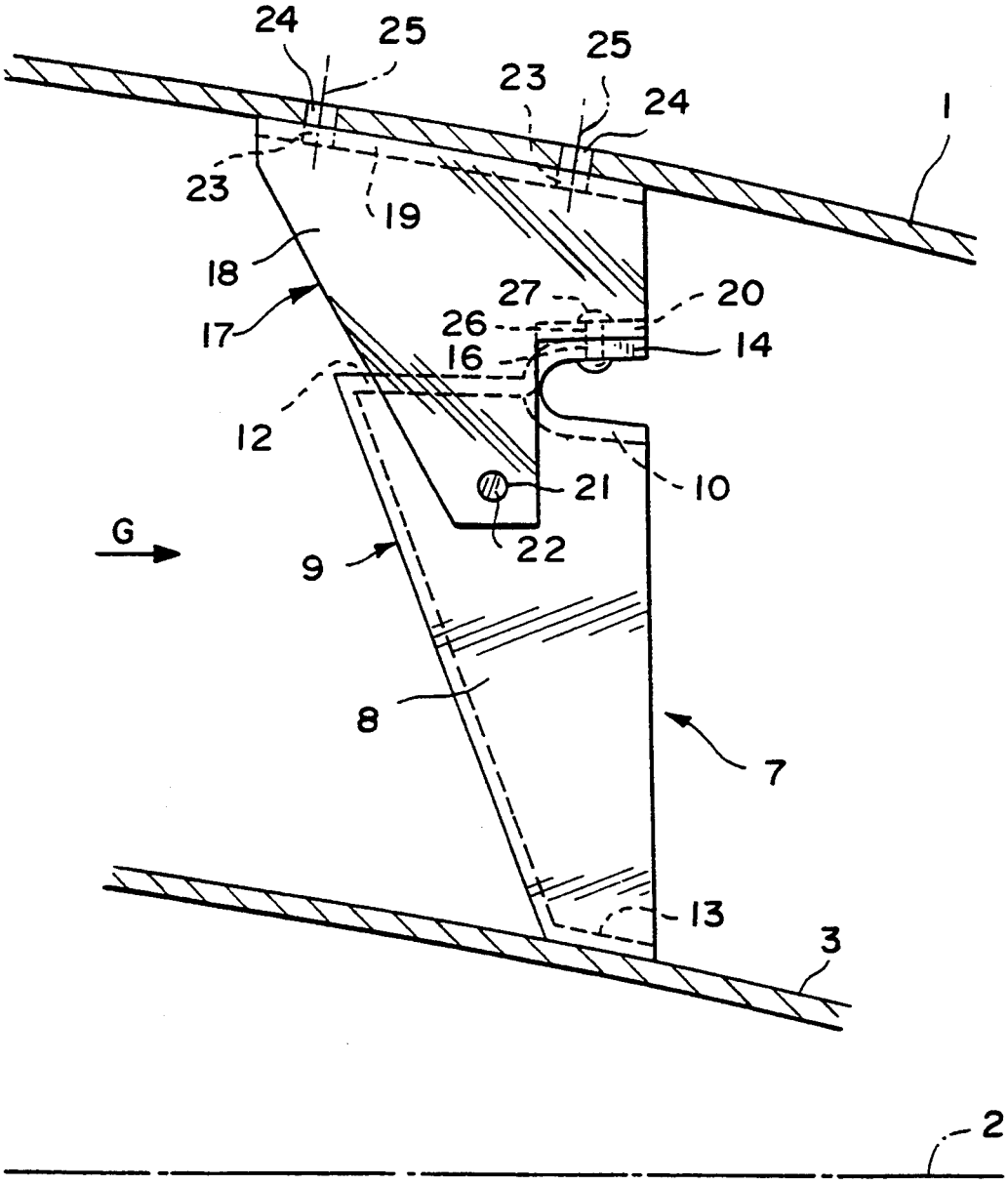
FIG. 2 is a cross-sectional view taken along line II—II in FIG. 1.
Figure 4:
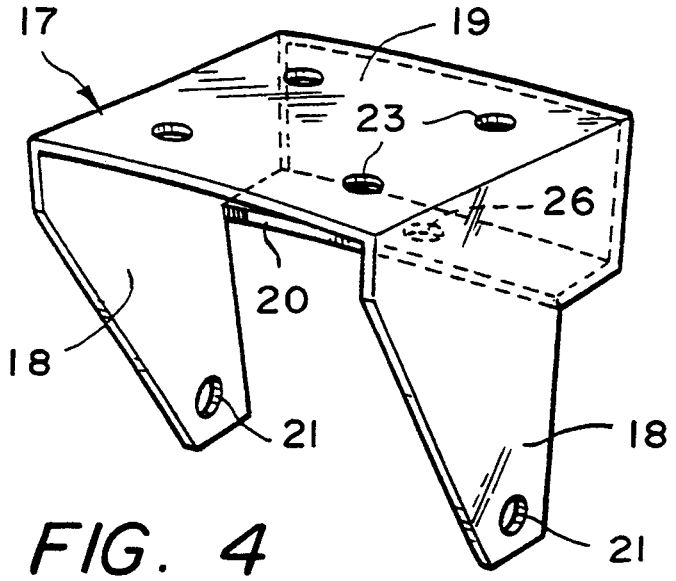
FIG. 4 is a perspective view of the support member according to the present invention.

The afterburner assembly according to the present invention comprises an outer casing 1 which forms a body of revolution about central axis 2 and a radially inwardly spaced inner casing 3 which also forms a body of revolution about central axis 2. The outer casing 1 and the inner casing 3 define therebetween an afterburner gas flow duct 6 through which gases flow in the direction of arrow G, illustrated in FIG. 2.

Figure 3:
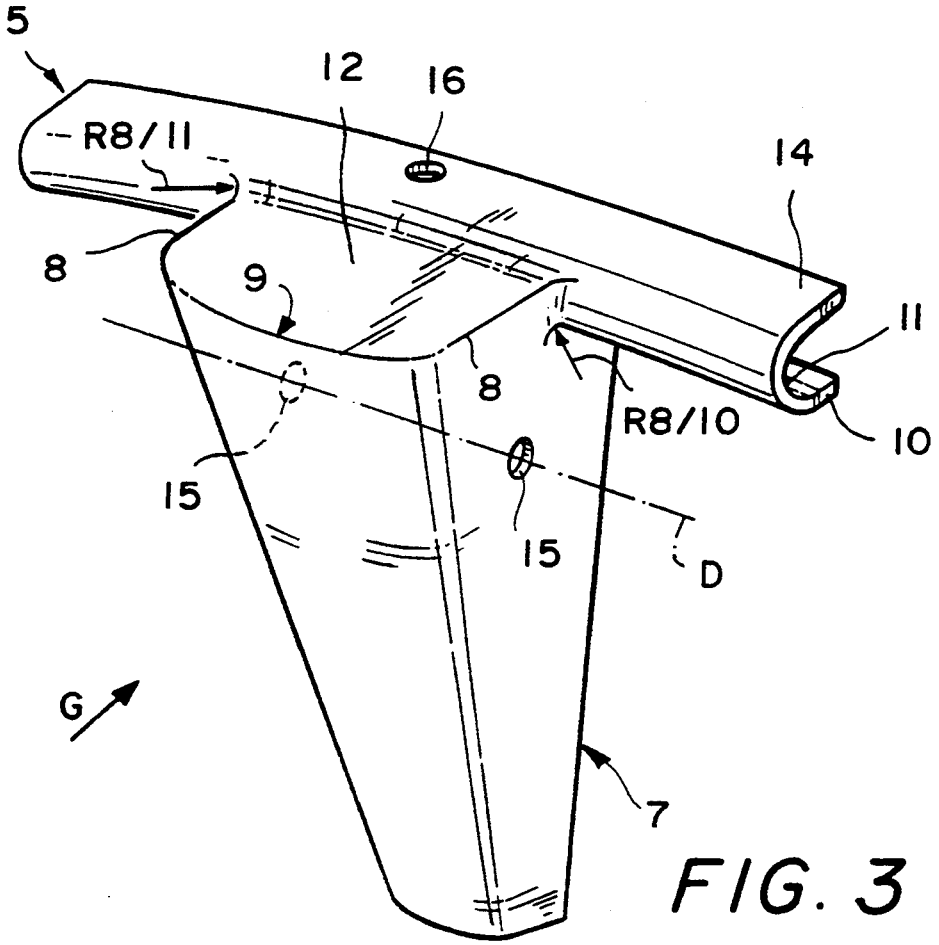
FIG. 3 is a perspective view of the arm/flameholder ring segment according to the present invention.

Located within this duct is a flameholder ring, generally illustrated at 4, which also forms a body having an axis of revolution 2. The flameholder ring 4 comprises a plurality of flameholder ring segments 5 positioned end-to-end, and each having a generally "U"-shaped cross-sectional configuration. The "U" opens in a downstream direction, away from the gas flow direction "G" inside the afterburner duct 6 and is located between the outer and inner casings 1 and 3, respectively. Each flameholder ring segment 5 is formed integrally with an arm 7 which extends generally radially relative to the central axis. As best illustrated in FIG. 3, each arm 7 is formed as an integral unit with flameholder ring segment 5 extending from opposite sides of the arm. Each arm 7 also has a generally "U" cross-sectional configuration with opposite legs 8 joined by convex base portion 9 oriented such that the convex outer side points in an upstream direction towards arrow G.

The upper portions of legs 8 merge into lower leg 10 of the flameholder ring segment 5 in a transition zone of which the radius of curvature R 8/10 is not constant. Each leg 8 also joins the front 11 of the flameholder ring segment 5 with a variable and progressive radius R 8/11. Each arm 7 also has an upper side 12 and a lower side 13 which extend between the opposite legs 8. The upper side 12 joins the front 11 of the flameholder ring segment 5, while lower side 13 forms a distal end and slidably contacts one of the casings, in this particular instance inner casing 3 allowing these elements to slide relative to one another.

The arm and flameholder ring segment 5 are formed as an integral unit and are made of a composite material capable of withstanding the high temperatures encountered in the afterburner duct 6. The integral unit may be fabricated from a fiber preform, which may comprise a carbon carbide, or silicon carbide fibers, impregnated with a liquid or gaseous matrix, such as a ceramic, glass, carbon, silicon carbide or carbon carbide matrix.

Opposite sides 8 of the arm 7 defines holes 15 which are aligned with each other along direction D substantially parallel to the flameholder ring segment 5. Upper leg 14 of the flameholder ring segment 5 defines hole 16 which extends generally orthogonal to direction D such that hole 16 is located substantially equidistantly from opposite ends of the flameholder ring segment 5.

Support member 17 serves to attach the arm 7 and flameholder ring segment 5 to the casing defining the afterburner duct 6. Support member 17 is also formed as an integral unit and may also be fabricated from the composite materials previously described. However, the composite material from which support member 17 is fabricated may be different from the composite material from which arm 7 and flameholder ring segment 5 unit is fabricated. Since the support member 17 is not subjected to as high a temperature as the arm 7 and flameholder ring segment 5, it may be fabricated from a more economical material using an organic matrix, or may even be fabricated from a metallic material.

Support member 17 has opposite sides 18 joined by a main bridge portion 19 and a secondary bridge portion 20. Each side 18 defines an opening 21 which openings are aligned with each other so that they may coincide with the direction D of openings 15 defined by the arm 7. The shape of the support member 17 allows the secondary bridge 20 to be located above and adjacent to the upper leg 14 of the flameholder ring segment and the opposite sides 18 to be located on either side of the sides 8 of the arm 7 such that holes 21 are aligned with holes 15. A pin 22 is inserted into the holes 15 and 21 to attach the arm 7 to the support member 17 such that it may be slightly pivotably with respect to the support member 17.

The main bridge portion 19 defines holes 23 which are aligned with holes 24 formed in the outer casing I to enable the support member 17 to be attached to the outer casing 1 by fasteners 25, such as bolts, rivets, or the like. Although the support member 17 is illustrated as being attached to the outer casing 1, it is to be understood that it may also be attached to the inner casing 3 without exceeding the scope of the present invention.

The secondary bridge portion 20 is located adjacent to, and above the upper leg 14 of the flameholder ring segment 5 and defines a hole 26 which is aligned with hole 16. A fastener 27 is inserted through these aligned holes. Fastener 27 may comprise a rivet, or the like.

The afterburner assembly according to the present invention enables the reduction of the overall mass in comparison to the known afterburner assemblies, by employing composites for the arm 7 and flameholder ring segment 5, as well as the support members.

The refractory properties of the composite materials enables the afterburner to be operated at high operational temperatures, thereby increasing the overall efficiency of the gas turbine engine. The manufacture of the afterburner assembly is also simplified due to the use of composites which enables the respective elements to be formed of simple shapes with uniform thicknesses.

The respective elements of the invention are rugged to enable them to withstand the aerodynamic stresses from the gas flow without causing damage. The shape of the elements enables them to be formed from a single layer of composite material, thereby reducing their size which, in turn, reduces the pressure losses through the afterburner assembly.

Thermal expansion of the parts relative to one another is achieved by the pivoting attachment of the arm 7 to its associated support member 17, as well as by the sliding contact between the distal end of arm 7 with its respective casing.

The foregoing description is provided for illustrative purposes only and should not be construed as in any way limiting this invention, the scope of which is defined solely by the appended claims.

We claim:

1. An afterburner assembly for a gas turbine engine comprising:

a) an outer casing extending about a central axis;

b) an inner casing extending about the central axis and spaced from the outer casing so as to define an afterburner duct therebetween;

c) a plurality of arms extending generally radially with respect to the central axis located in the afterburner duct, each arm having a segment of a flameholder ring integrally formed therewith and extending from opposite sides of each arm; and, d) a support member attached to each arm and to the outer casing such that the flameholder ring segments form an annular flameholder ring extending about the central axis, wherein the support members are attached to the outer casing such that the inner end of the arms slidably contact the inner casing.

2. The afterburner assembly of claim 1 wherein each flameholder ring segment has a generally "U"-shaped cross-sectional configuration having opposite legs extending generally parallel to the central axis.

3. The afterburner assembly of claim 2 further comprising:

a) a first hole defined by one of the opposite legs of one of said flameholder ring segments;

b) a second hole defined by one of said support members; and, c) fastener means extending through the first and second holes.

4. The afterburner assembly of claim 1 wherein each arm has opposite sides and further comprising:

a) first openings defined by each opposite side of each arm;

b) second openings defined by the support member; and, c) fastener means extending through the first and second openings to attach the support member to the arm.

5. The afterburner assembly of claim 4 wherein the fastener means comprises a pin member.

6. The afterburner assembly of claim 1 wherein the arms and the associated flameholder ring segments are formed as an integral unit of a composite material.

7. The afterburner assembly of claim 6 wherein the composite material comprises a preform clad by a matrix wherein the preform comprises silicon carbide fibers.

8. The afterburner assembly of claim 7 wherein the matrix comprises silicon carbide.

9. The afterburner assembly of claim 7 wherein the matrix comprises carbon carbide.

10. The afterburner assembly of claim 6 wherein the composite material comprises a preform clad by a matrix wherein the preform comprises carbon carbide fibers.

11. The afterburner assembly of claim 10 wherein the matrix comprises silicon carbide.

12. The afterburner assembly of claim 10 wherein the matrix comprises carbon carbide.

13. The afterburner assembly of claim 1 wherein the support members are formed from a composite material.

14. The afterburner assembly of claim 13 wherein the composite material comprises a preform clad by a matrix wherein the preform comprises silicon carbide fibers.

15. The afterburner assembly of claim 14 wherein the matrix comprises silicon carbide.

16. The afterburner assembly of claim 14 wherein the matrix comprises carbon carbide.

17. The afterburner assembly of claim 13 wherein the composite material comprises a preform clad by a matrix wherein the preform comprises carbon carbide fibers.

18. The afterburner assembly of claim 17 wherein the matrix comprises silicon carbide.

19. The afterburner assembly of claim 14 wherein the matrix comprises carbon carbide.

20. The afterburner assembly for a gas turbine engine comprising:

a) an outer casing extending about a central axis;

b) an inner casing extending about the central axis and spaced from the outer casing so as to define an afterburner duct therebetween;

c) a plurality of arms extending generally radially with respect to the central axis located in the afterburner duct, each arm having a segment of a flameholder ring integrally formed therewith and extending from opposite sides of the arm wherein the flameholder ring segment has a generally "U"-shaped cross-sectional configuration having opposite legs extending generally parallel to the central axis;

d) a support member attached to each arm and to one of the inner and outer casings such that the flameholder ring segments form an annular flameholder ring extending about the central axis;

e) a first hole defined by one of the opposite legs of the flameholder ring segment;

f) a second hole defined the support member; and, g) fastener means extending through the first and second holes.

21. The afterburner assembly of claim 20 wherein each arm has opposite sides and further comprising:

a) first openings defined by each opposite side of each arm;

b) second openings defined by each support member; and, c) fastener means extending through the first and second openings to attach each support member to the arm.

22. The afterburner assembly of claim 21 wherein the fastener means comprises pin member.

23. The afterburner assembly of claim 20 wherein the arms and the associated flameholder ring segments are formed as an integral unit of a composite material.

24. The afterburner assembly of claim 23 wherein the composite material comprises a preform clad by a matrix wherein the preform comprises silicon carbide fibers.

25. The afterburner assembly of claim 24 wherein the matrix comprises silicon carbide.

26. The afterburner assembly of claim 24 wherein the matrix comprises carbon dioxide.

27. The afterburner assembly of claim 23 wherein the composite material comprises a preform clad by a matrix wherein the preform comprises carbon carbide fibers.

28. The afterburner assembly of claim 27 wherein the matrix comprises silicon carbide.

29. The afterburner assembly of claim 27 wherein the matrix comprises carbon carbide.

30. The afterburner assembly of claim 20 wherein the support members are formed from a composite material.

31. The afterburner assembly of claim 30 wherein the composite material comprises a preform clad by a matrix wherein the preform comprises silicon carbide fibers.

32. The afterburner assembly of claim 31 wherein the matrix comprises silicon carbide.

33. The afterburner assembly of claim 31 wherein the matrix comprises carbon carbide.

34. The afterburner assembly of claim 30 wherein the composite material comprises a preform clad by a matrix wherein the preform comprises carbon carbide fibers.

35. The afterburner assembly of claim 34 wherein the matrix comprises silicon carbide.

36. The afterburner assembly of claim 34 wherein the matrix comprises carbon carbide.

* * * * *